US009795202B1

(12) United States Patent
Zhang

(10) Patent No.: US 9,795,202 B1
(45) Date of Patent: Oct. 24, 2017

(54) SEALING COSMETIC COMPACT

(71) Applicant: Derik Zhang, Liaobu Town Dongguan (CN)

(72) Inventor: Derik Zhang, Liaobu Town Dongguan (CN)

(73) Assignee: Lava Industries, Inc., Monterey Park, CA (US)

( * ) Notice: Subject to any disclaimer, the term of this patent is extended or adjusted under 35 U.S.C. 154(b) by 0 days.

(21) Appl. No.: 14/999,060

(22) Filed: Mar. 25, 2016

(51) Int. Cl.

| | |
|---|---|
| ***B65D 41/00*** | (2006.01) |
| ***A45D 33/00*** | (2006.01) |
| ***B65D 53/02*** | (2006.01) |
| ***B65D 45/02*** | (2006.01) |

(52) U.S. Cl.
CPC ..... *A45D 33/003* (2013.01); *B65D 45/02* (2013.01); *B65D 53/02* (2013.01)

(58) Field of Classification Search
CPC ..... B65D 53/00; B65D 53/02
See application file for complete search history.

(56) References Cited

U.S. PATENT DOCUMENTS

2013/0087165 A1* 4/2013 Lee ..... A45C 13/008 132/286
2015/0027487 A1* 1/2015 Apodaca ..... A45D 33/006 132/307

* cited by examiner

*Primary Examiner* — Steven A. Reynolds
*Assistant Examiner* — Javier A Pagan
(74) *Attorney, Agent, or Firm* — William W. Haefliger

(57) ABSTRACT

A cosmetic device comprises a case having a base defining a first upright wall extending about a cosmetic powder reception zone, a seal ring extending about said wall, and having a lip overlying an upper edge of said wall, said edge tapering downwardly and inwardly toward said zone, a cover movable downwardly over said zone to close the case, said cover having a downward facing surface overlying said lip and movable downwardly with the cover to deflect said lip toward and sealingly adjacent said upper edge.

5 Claims, 3 Drawing Sheets

SEALING COSMETIC COMPACT

BACKGROUND OF THE INVENTION

This invention relates generally to improvements in cosmetic compacts, and more particularly to automatic sealing of components upon being closed, and ready opening after being tightly closed in sealed condition.

There is need for simple, effective, and improved construction of cosmetic compacts that will provide such improvements. Also, there is need for such compacts as are further described herein.

SUMMARY OF THE INVENTION

It is a major object of the invention to provide a simple, highly effective and easily usable cosmetics compact having a) a case defining a base having a first upright wall extending about a cosmetic powder reception zone, b) a seal ring extending about said wall, and having a lip overlying an upper edge of said wall, said edge tapering downwardly and inwardly toward said zone, c) a cover movable downwardly over said zone to close the case, said cover having a downward facing surface overlying said lip and movable downwardly with the cover to deflect said lip toward and sealingly adjacent said upper edge.

As will be seen, the cover typically has a downwardly extending inner wall defining said surface engaging innermost extent of said lip.

A further object includes a flange on the cover lip located to block upward protrusion of the lip during said lip deflection.

Typically the lip tapers inwardly toward the case inner wall to provide for progressive and enhanced sealing as the cover is closed downwardly.

In this regard, the base upright wall supports lowermost extent of the lip to enable progressive sealing action as the cover closes the case. Further, the base typically has a second upright wall extending adjacent outermost extent of the lip. The lip preferably has an upright wall confined between the base walls, to anchor the lip in position during its flexing and sealing.

Another object includes provision of a powder reception zone defined by said second upright wall.

These and other objects and advantages of the invention, as well as the details of an illustrative embodiment, will be more fully understood from the following specification and drawings, in which:

DRAWING DESCRIPTION

DETAILED DESCRIPTION

Figure 1:
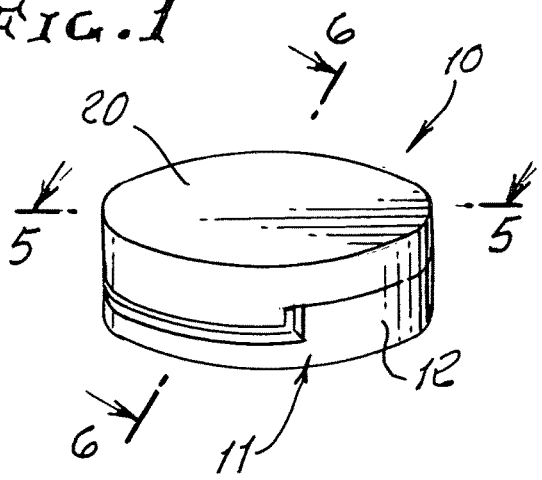
FIG. 1 is a perspective view showing the cover closed down upon the case base.
Figure 3:
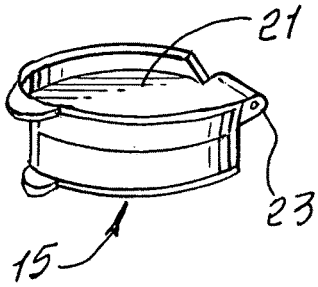
FIG. 3 is a perspective view showing the cover closed over the base.
Figure 4:
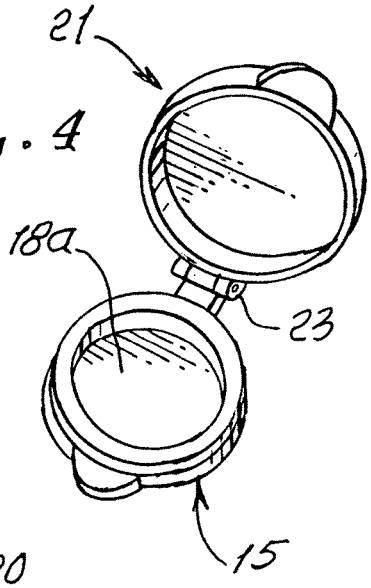
FIG. 4 is a perspective view showing the cover raised over the base and seal ring.
Figure 2:
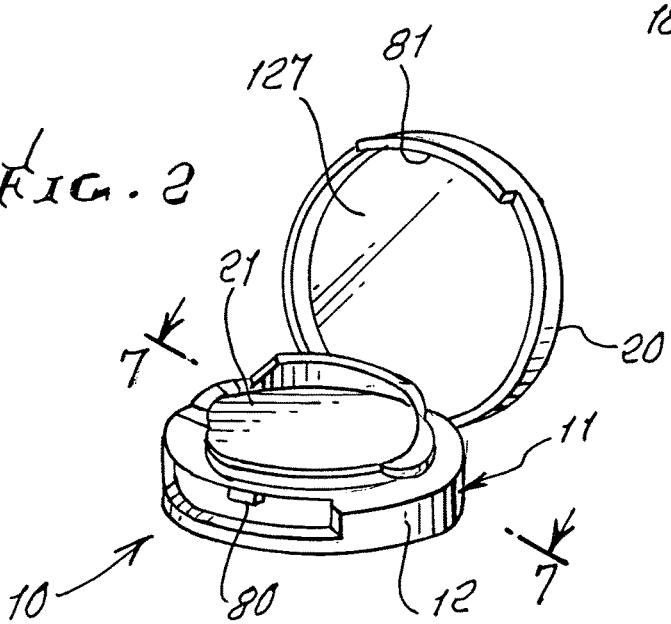
FIG. 2 is like FIG. 1, but with the cover opened.

In FIGS. 1-6, the cosmetics case 10 includes a generally circular first base 11 having a side wall 12, bottom wall 13 and a downwardly re-entrant interior 14. A second base 15, relatively smaller than first base 11, fits downwardly into base 11, as shown, so that ledge 16 of base 15 seats on ledge 11*a* of base 11, at 17. Base 15 is downwardly re-entrant and forms a centered reception zone for cosmetics, such as powder 18 or the like.

Cover structure includes a relatively larger cover or cap 20, and a relatively smaller cover 21 fitting downwardly at shoulder 22 formed by smaller base 15. The covers are pivotally connected at 23 to the smaller base's upwardly projecting support 24, whereby they may be pivotally swung upwardly as at 26 in FIG. 6, to provide access to the powder 18 in zone 18*a*, and to a mirror 127 retained at 28 between an upstanding ledge 29 of the small base and the top wall 30 of the cover.

Figure 5:
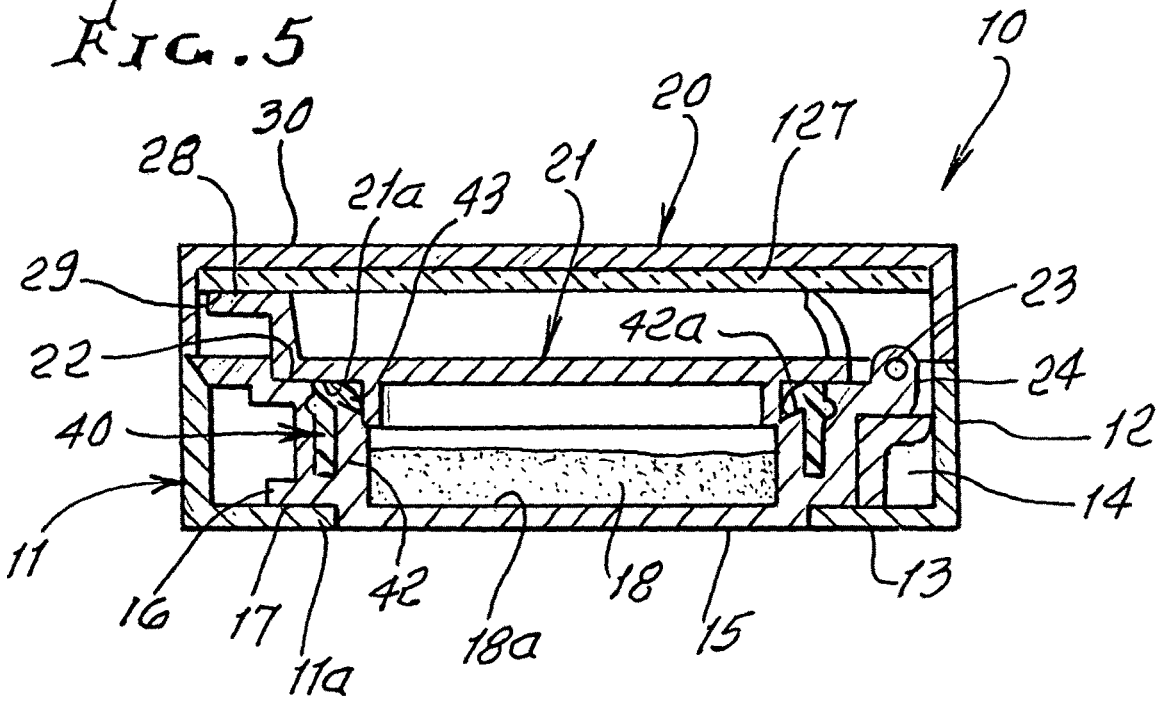
FIG. 5 is an enlarged section taken on lines 5-5 of FIG. 1.
Figure 6:
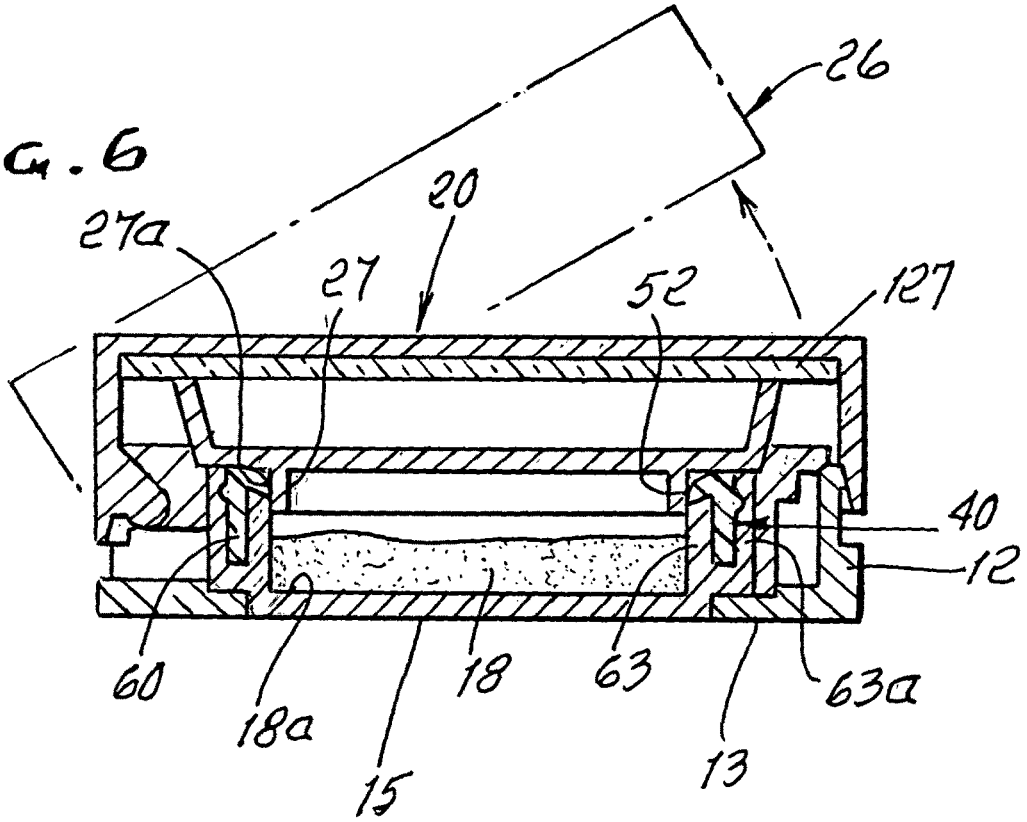
FIG. 6 is an enlarged section taken on lines 6-6 of FIG. 1.
Figure 7:
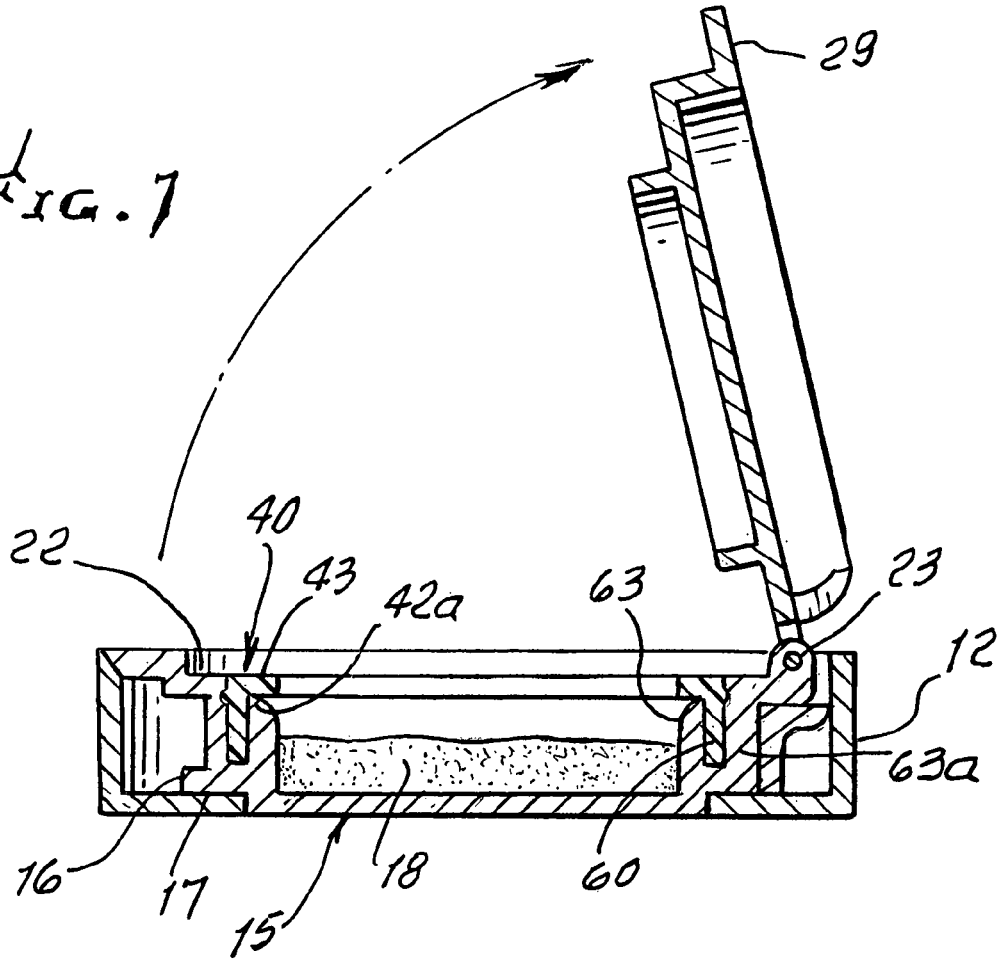
FIG. 7 is a section like FIG. 5, but showing enlarged cover and base elements.

A seal ring 40 extends about upright wall 42 defined by the small base, and has a lip 43 overlying upper edge 42*a* of that wall. Edge 42*a* tapers downwardly and inwardly toward the powder reception zone 18*a*. The smaller cover 21 is movable downwardly over that zone to close the case, that cover having a downward facing surface 21*a* overlying the flexible lip 43 on seal ring 40 and movable downwardly with the cover to deflect the innermost extent of lip 43 of ring 40 toward and sealingly adjacent annular surface of said tapered upper edge 42*a*, as seen in FIG. 5. A tight seal is thereby established at 52, as seen in FIG. 6, maintaining powder 18 in fresh condition.

In this regard, surface 21*a* is formed on the underside of the smaller cover, and overlies the lip to block upward protrusion of the lip during such lip deflection. Side surface 27*a* of flange 27 carried by 21 engages and deflects the lip downwardly. See FIG. 6. The lip upper surface tapers inwardly and downwardly toward the powder zone to assist captivation and flexing of the lip, and seal formation, during closing of the compact.

It will be noted that the smaller base supports lowermost upright extent 60 of annular seal forming ring 40. The seal and lip consist of compressible relatively soft sealing material such as flexible plastic. The smaller base also defines a second upright wall 63 extending adjacent, and confining, outermost extent of the seal at lip level. Upright wall 60 of the annular seal is confined between the base upright flanges 63 and 63*a*, and exerts reaction pressure on the lip in response to downward compression of the lip during its downward flexing.

A large cover latch is shown at 80. Downward arcuate local enlargement of the large cover 20 at 81 assists opening and closing of the large cover.

Figure 8:
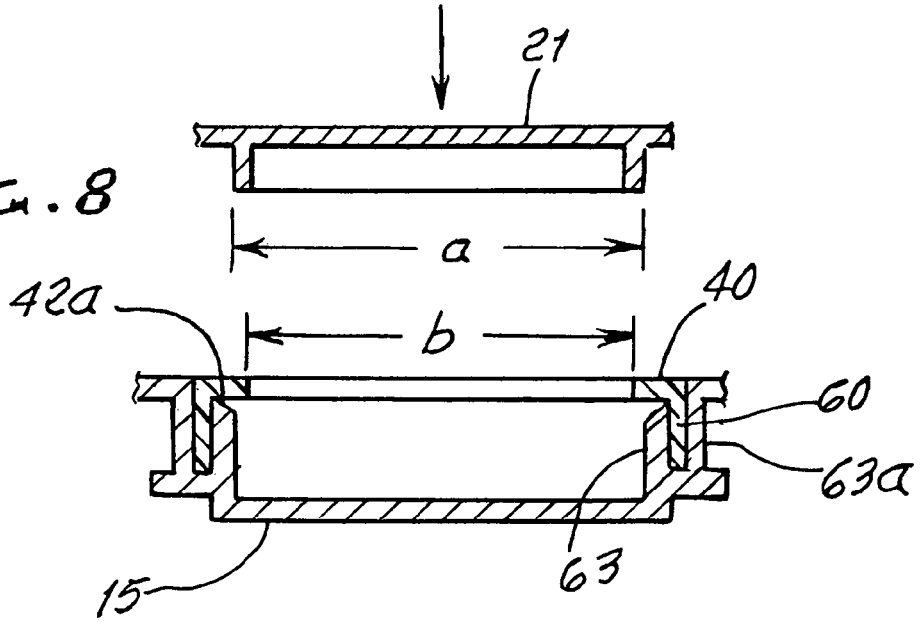
FIG. 8 is an exploded section, taken in elevation to show cover, base and seal elements prior to case closing.

In FIG. 8, dimension "a" exceeding dimension "b", enhancing sealing at 27 and 27*a*.

As show, the invention provides:

a) a case having a base defining a first upright wall extending about a cosmetic powder reception zone, b) a seal ring extending about said wall, and having a lip overlying an upper edge defined by said wall, said edge tapering downwardly and inwardly toward said zone, said lip having sidewardly projecting extent, c) a cover movable downwardly over said zone to close the case, said cover having a downward facing surface overlying said sidewardly projecting extent of said lip and movable downwardly with the cover to deflect said lip toward and sealingly adjacent said upper edge, d) the cover having a flange with a side surface toward which said tapering edge extends, the lip sidewardly and terminally engaging said flange side surface.

I claim:

1. A cosmetics case compact comprising:

a) a case having a base defining a first upright wall extending about a cosmetic powder reception zone;

b) a seal ring extending about said first upright wall, and having a lip overlying an upper edge defined by said first upright wall, a portion of said upper edge tapering downwardly and inwardly below said upper edge toward said cosmetic powder reception zone, said lip having a sidewardly projecting extent, facing said upper edge, said seal ring including an upright wall below said lip;

c) a cover movable downwardly over said cosmetic powder reception zone to close the case, said cover having a downward facing surface overlying said sidewardly projecting extent of said lip and movable downwardly with the cover to deflect said lip toward and sealingly adjacent to said upper edge;

d) the cover having a downwardly projecting flange with a side surface toward which said tapering upper edge extends, the lip sidewardly and terminally engaging said downwardly projecting flange side surface, and wherein the downwardly projecting flange extends downwardly below a lowermost extent of said downward facing surface of said cover; and e) the base further comprising a second upright wall and an upright flange wherein said upright wall of said seal ring is confined between the second upright wall and the upright flange of the base.

2. The compact of claim 1 wherein the cover has a wall overlying said lip to block upward protrusion of the lip during said lip deflection.

3. The compact of claim 1, wherein the base supports a lowermost extent of the seal ring forming said lip.

4. The compact of claim 1, wherein the second upright wall extends adjacent an outermost extent of the lip.

5. The compact of claim 1, wherein said base is received within a larger base; and wherein said cover is received within a larger cover.

* * * * *